US007591710B2

(12) United States Patent
Drain et al.

(10) Patent No.: US 7,591,710 B2
(45) Date of Patent: Sep. 22, 2009

(54) POLISHING MACHINE COMPRISING A WORK CHAMBER AND A PLATFORM

(75) Inventors: James W. Drain, Carpinteria, CA (US); John R. Keller, Santa Barbara, CA (US); Steven L. Reid, Goleta, CA (US); Joseph K. Bond, Carpinteria, CA (US); Maggy Perrier, Guignes (FR); Laurent Marcepoil, Chatillon (FR); Eric Comte, Thorigny sur Marne (FR)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 108 days.

(21) Appl. No.: 11/320,734

(22) Filed: Dec. 30, 2005

(65) Prior Publication Data

US 2007/0155286 A1 Jul. 5, 2007

(51) Int. Cl.
*B24B 49/00* (2006.01)

(52) U.S. Cl. ..... 451/11; 451/14; 451/240

(58) Field of Classification Search ..... 451/11, 451/14, 19, 24, 42, 240, 255, 256, 277, 323
See application file for complete search history.

(56) References Cited

U.S. PATENT DOCUMENTS

| | | | | |
|---|---|---|---|---|
| 1,893,955 | A | | 1/1933 | Maynard |
| 2,579,193 | A | | 12/1951 | Kosbab |
| 4,232,485 | A | * | 11/1980 | Eadon-Allen ..... 451/159 |
| 4,521,994 | A | | 6/1985 | Tusinski |
| 4,920,700 | A | * | 5/1990 | Murahashi et al. ..... 451/277 |
| 5,482,495 | A | * | 1/1996 | Mayahara et al. ..... 451/5 |
| 5,679,054 | A | * | 10/1997 | Chun et al. ..... 451/9 |
| 6,080,044 | A | | 6/2000 | Lanham et al. |
| 6,106,366 | A | * | 8/2000 | Dixon et al. ..... 451/10 |
| 6,123,610 | A | * | 9/2000 | Larsen ..... 451/285 |
| 6,394,892 | B2 | * | 5/2002 | Hanisch et al. ..... 451/259 |
| 2002/0006764 | A1 | | 1/2002 | Hanisch et al. |

FOREIGN PATENT DOCUMENTS

| | | |
|---|---|---|
| DE | 10 2004 021721 | 10/2005 |
| EP | 0 945 218 | 9/1999 |
| GB | 127971 | 6/1919 |
| GB | 2 002 662 | 2/1979 |
| JP | 64-27846 | 1/1989 |
| WO | WO 2005/105372 | 11/2005 |

* cited by examiner

*Primary Examiner*—Dung Van Nguyen
(74) *Attorney, Agent, or Firm*—Young & Thompson

(57) ABSTRACT

A polishing machine for optical elements, comprising:
a spindle arranged to rotationally drive an optical element;
a polishing tool mobile relative to the spindle; wherein the polishing machine further comprises a platform mounted on top of a work chamber, the work chamber comprising the spindle, and the platform holding a body on which is mounted the polishing tool.

19 Claims, 11 Drawing Sheets

POLISHING MACHINE COMPRISING A WORK CHAMBER AND A PLATFORM

FIELD OF THE INVENTION

The invention relates to a polishing machine, and more particularly to a polishing machine arranged to polish optical elements such as ophthalmic lenses.

SUBJECT OF THE INVENTION

One object of the invention is to provide a modular polishing machine.

According to one aspect, the invention relates to a polishing machine for optical elements, comprising:

a spindle arranged to rotationally drive an optical element;

a polishing tool mobile relative to the spindle; wherein the polishing machine further comprises a platform mounted on top of a work chamber, the work chamber comprising the spindle, and the platform holding a body on which is mounted the polishing tool.

The platform which is holding all the mechanical parts related to the motion of the polishing tool is mounted as a sub-assembly of the polishing machine. The platform can thus easily be separated from the work chamber. Advantageously, the sub-assembly could also easily be repaired or replaced.

According to other preferred features:

the body is mounted on sliding means;

the sliding means are mounted on a rail affixed to the platform;

the sliding means are driven by a ball screw mounted on the platform;

the ball screw is rotationally driven by a motor affixed to the platform;

the ball screw is protected by bellows;

the body is rotationally mounted on the sliding means by way of an axis;

the polishing machine further comprises a first jack arranged to rotationally drive the body;

the polishing machine further comprises a second spindle arranged to cooperate with a second polishing tool mounted on a second body which is secured on the platform;

the body is a second jack provided with a rod, the rod being arranged to hold the polishing tool;

the polishing machine further comprises a polishing fluid circuit for projecting polishing fluid into the work chamber, the polishing fluid circuit comprising a drawer releasable from the polishing machine and holding a tank, a pump and a filter;

the drawer is arranged to move relative to the work chamber;

the polishing fluid circuit comprises a quick release coupling mounted on the drawer and arranged to disconnect the drawer from the rest of the polishing machine;

the spindle is rotationally driven by a motor located at the same level than the spindle;

the motor and the spindle are mounted on a same platform;

the motor rotationally drives the spindle by way of a belt;

the platform are insulated from the work chamber by means of a dome attached to the body and a lip seal closing onto the dome;

the polishing machine further comprises bellows attached to the body and to the platform;

the sliding means are mounted on a rail which is protected by bellows attached to the sliding means;

the work chamber comprises a door enabling the access to the spindle and to the polishing tool, the door being rotationally mounted on an arm;

the arm is rotationally mounted relative to the work chamber by way of an axis;

the arm is rotationally driven around the axis by a jack.

A further object of the invention is to provide a polishing machine for optical elements, comprising:

a spindle adapted to rotationally drive an optical element;

a polishing tool mobile relative to the spindle;

said spindle being rotationally driven by a motor located at the same level than the spindle.

The motor and the spindle could be mounted on a same platform.

According to a preferred feature, the motor rotationally drives the spindle by way of a belt.

A further object of the invention is to provide a polishing machine for optical elements, comprising:

a spindle adapted to rotationally drive an optical element;

a polishing tool mobile relative to the spindle;

a polishing fluid circuit for projecting and polishing fluid into the work chamber, said polishing fluid circuit comprising a drawer releasable from the polishing machine and holding a tank, a pump and a filter.

According to a preferred feature, the drawer comprises wheels for its displacement on the floor.

According to another preferred feature, the polishing fluid circuit comprises a quick released coupling mounted on the drawer and adapted to disconnect the drawer from the rest of the polishing machine.

BRIEF DESCRIPTION OF THE DRAWINGS

Other features and advantages of the invention appear in the light of the following description of a preferred embodiment, given by way of non-limiting example, and made with reference to the accompanying drawings in which.

DETAILED DESCRIPTION OF AN EMBODIMENT

Figure 1:
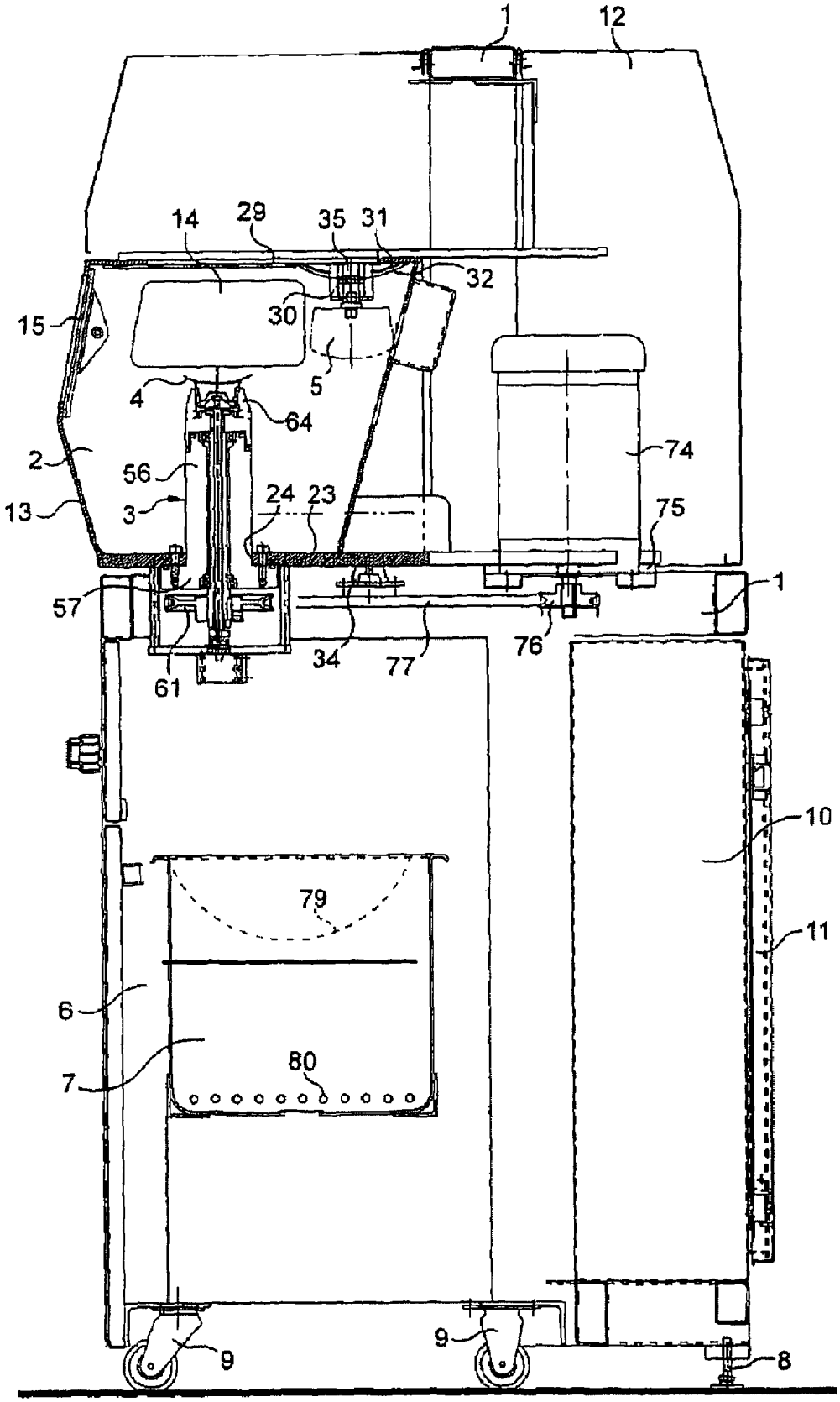
FIG. 1 is a side view, in longitudinal cross-section, of a machine according to the invention.
Figure 2:
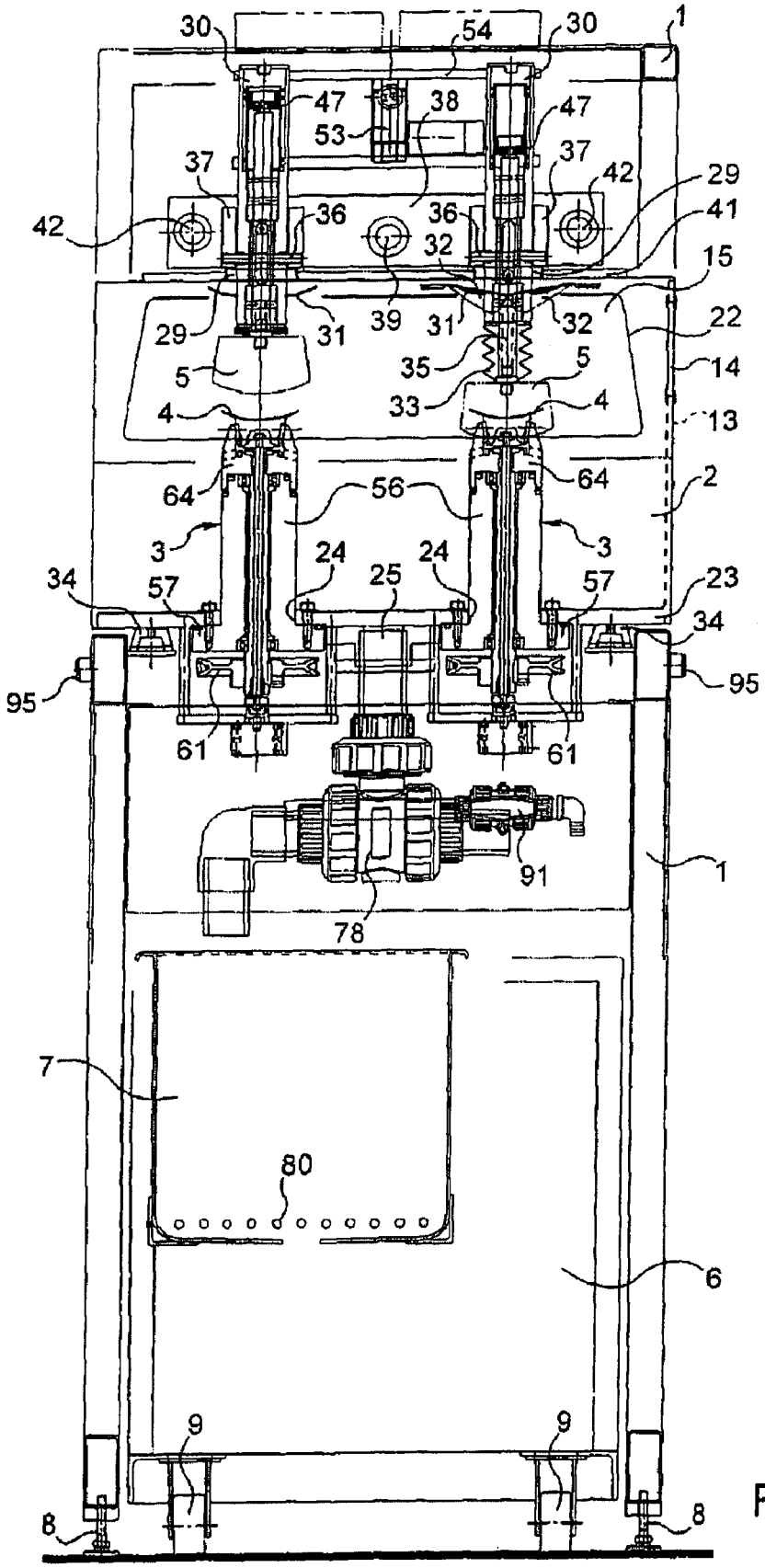
FIG. 2 is a diagrammatic front view of the machine of FIG. 1 showing by transparency the various parts that constitute it.
Figure 3:
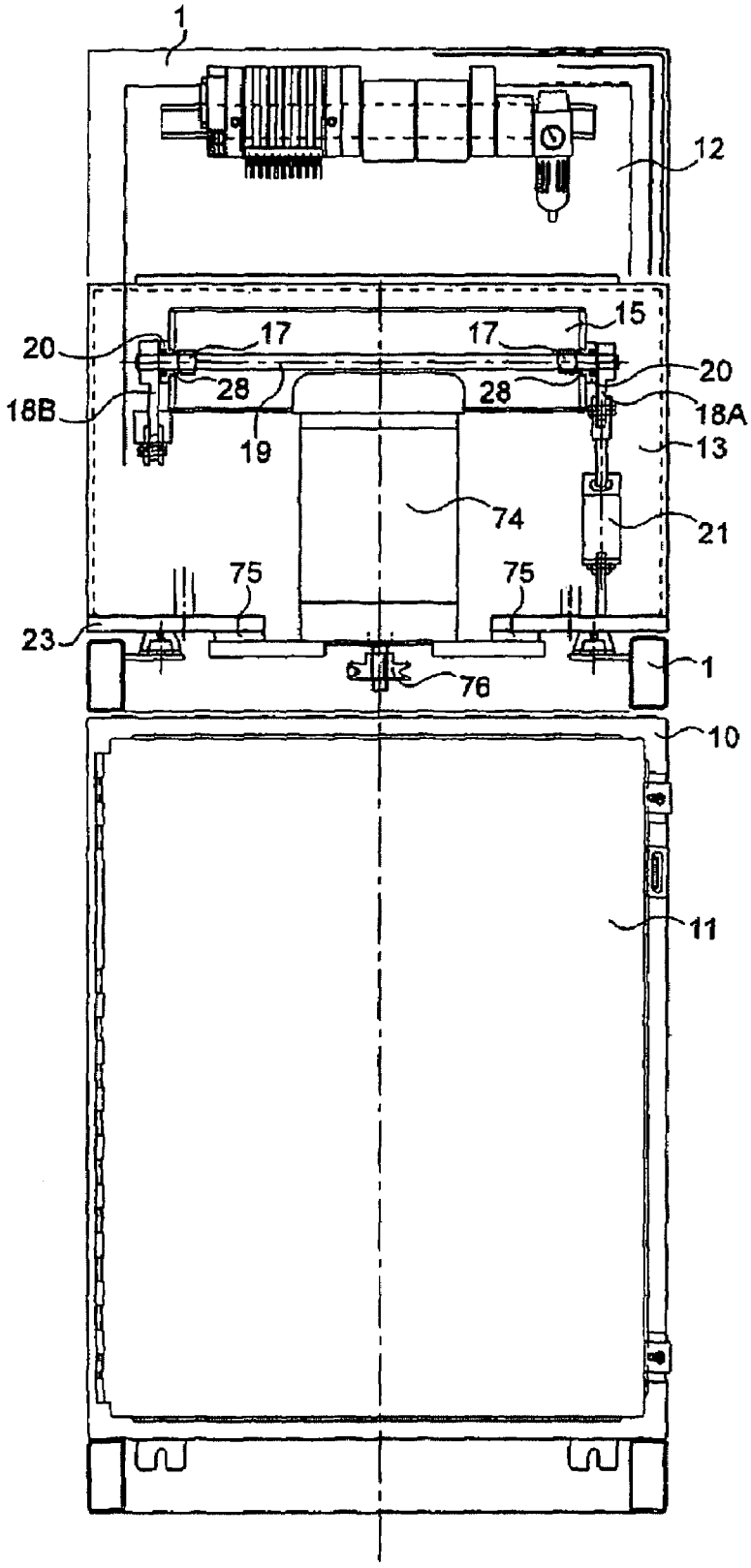
FIG. 3 is a diagrammatic view of the rear of the machine of FIGS. 1 and 2.

The production machine represented in FIGS. 1 to 3 is, in the present example, a polishing machine adapted for finishing ophthalmic lenses for corrective glasses.

With reference to FIG. 1, the polishing machine comprises a frame 1 bearing a work chamber 2 in which the polishing operations take place.

Two spindles 3 are arranged within the work chamber 2 (see FIG. 2) and each makes it possible to hold in position an ophthalmic lens 4 to be polished. Each spindle 3 is adapted to rotationally drive the lens 4 which it holds for the purpose of polishing it by virtue of a polishing tool 5 adapted to come into contact with the lens 4.

The polishing tool 5 is connected to a tool drive device situated above the work chamber 2. This construction in two clearly differentiated modules enables a machine to be obtained of which the mounting and maintenance are facilitated.

In the course of the polishing operations, during the contact of the tool 5 with the rotationally driven lens 4, a fluid circulation device (described later) enables polishing fluid to be projected onto the tool 5 and onto the lens 4 in a manner that is conventional in this type of application. The polishing fluid may for example be a lubricant which may possibly contain abrasive particles.

The frame 1 also bears, in its lower portion, a drawer 6 for access to a tank 7 for recovery of the polishing fluid. The frame 1 rests fixedly on the ground through the intermediary of adjustable feet 8 (see FIGS. 1 and 2) whereas the drawer 6 rests on four wheels 9 enabling it to be drawn forwardly giving access to the tank 7. Only the pipes enabling the polishing fluid to circulate connect the members of the drawer 6 to the remainder of the machine.

Furthermore, the construction of the machine in two separate modules, i.e. a work chamber 2 and a tool driving device situated above the latter, also make it possible to provide protection for the tool driving device against the flow of the polishing fluid, the latter flowing by gravity towards the bottom of the work chamber 2.

In its lower portion, the frame 1 also bears an electrical cabinet 10 comprising a door 11 mounted on hinges and adapted to hermetically seal the cabinet 10. The electrical cabinet 10 is adapted to receive the electric power parts as well as the different electronic units for governing and control connected to the electric actuators of the machine.

Finally, in its upper rear portion, the polishing machine receives a pneumatic cabinet 12 (see FIG. 3) containing the conventional parts necessary for the connection of the machine to a source of compressed air, such as filters and pressure regulators.

The parts of the polishing machine which have just been presented briefly above will now each be described in more detail.

Work Chamber

The work chamber 2 is designed as a fluid-tight box in which polishing operations take place comprising the projection of the polishing fluid. The fluid-tightness of the work chamber 2 is necessary to prevent the polishing fluid from entering into contact with the motorized parts of the machine in order not to damage them.

The polishing chamber 2 comprises an enclosed space 13 preferably formed from a corrosion resistant material such as a polymer, an aluminum or a stainless steel. The inner walls of the enclosure 13 advantageously comprise a non-stick coating such as teflon or an appropriate paint, in order to facilitate the flow of the polishing liquid along the walls.

The enclosure 13 comprises two transparent side windows 14 enabling the operator to check the polishing operations visually.

The windows 14 may also be hinged to the enclosure 13 and thus open.

Figure 4:
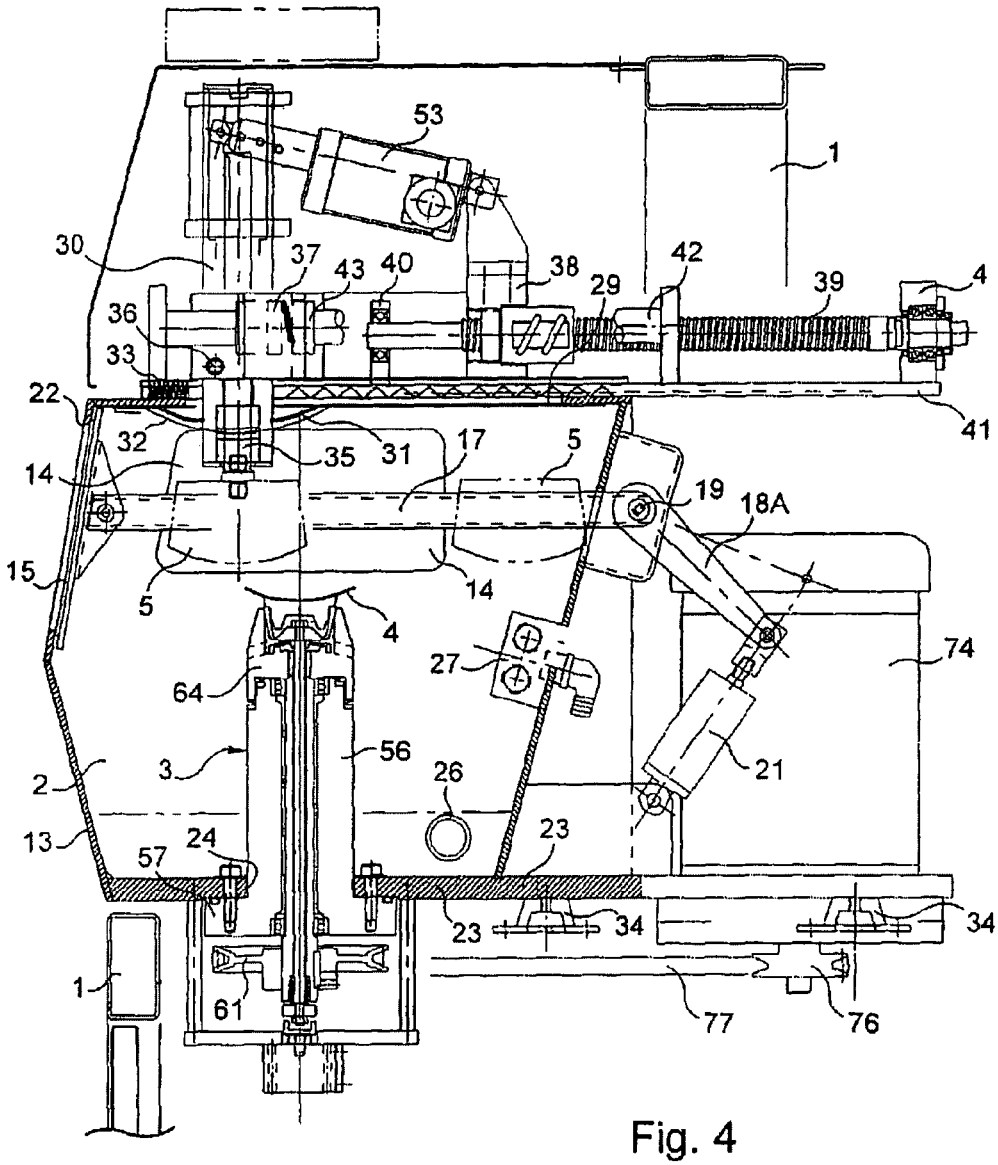
FIG. 4 is a detail view of the upper portion of the machine of FIG. 1.

The enclosure 13 also comprises a front opening 22 which may be closed by a door 15 enabling the operator to access the inside of the work chamber 2, in particular to load and unload the lenses 4 to be polished or to change the polishing tool 5. In FIG. 4, door 15 is closed whereas it is open in FIG. 5. Door 15 is preferably transparent also to enable the polishing operations to be checked when the operator is in front of the machine. A seal 16 disposed on the periphery of the door 15 furthermore enables the work chamber 2 to be made fluid-tight when the door 15 is closed.

Figure 5:
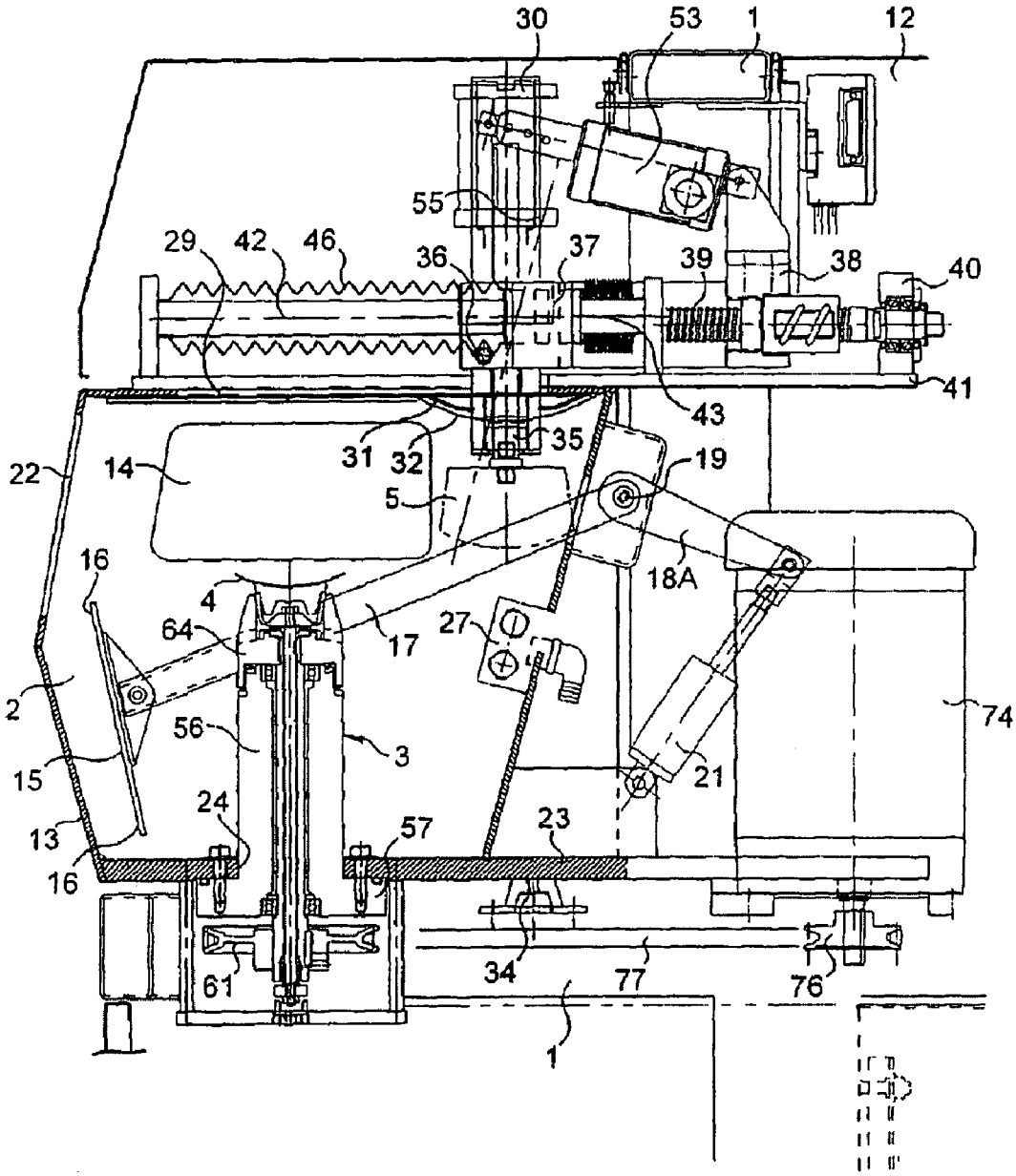
FIG. 5 is a similar view to FIG. 4 but showing the movable parts in other positions.
Figure 10:
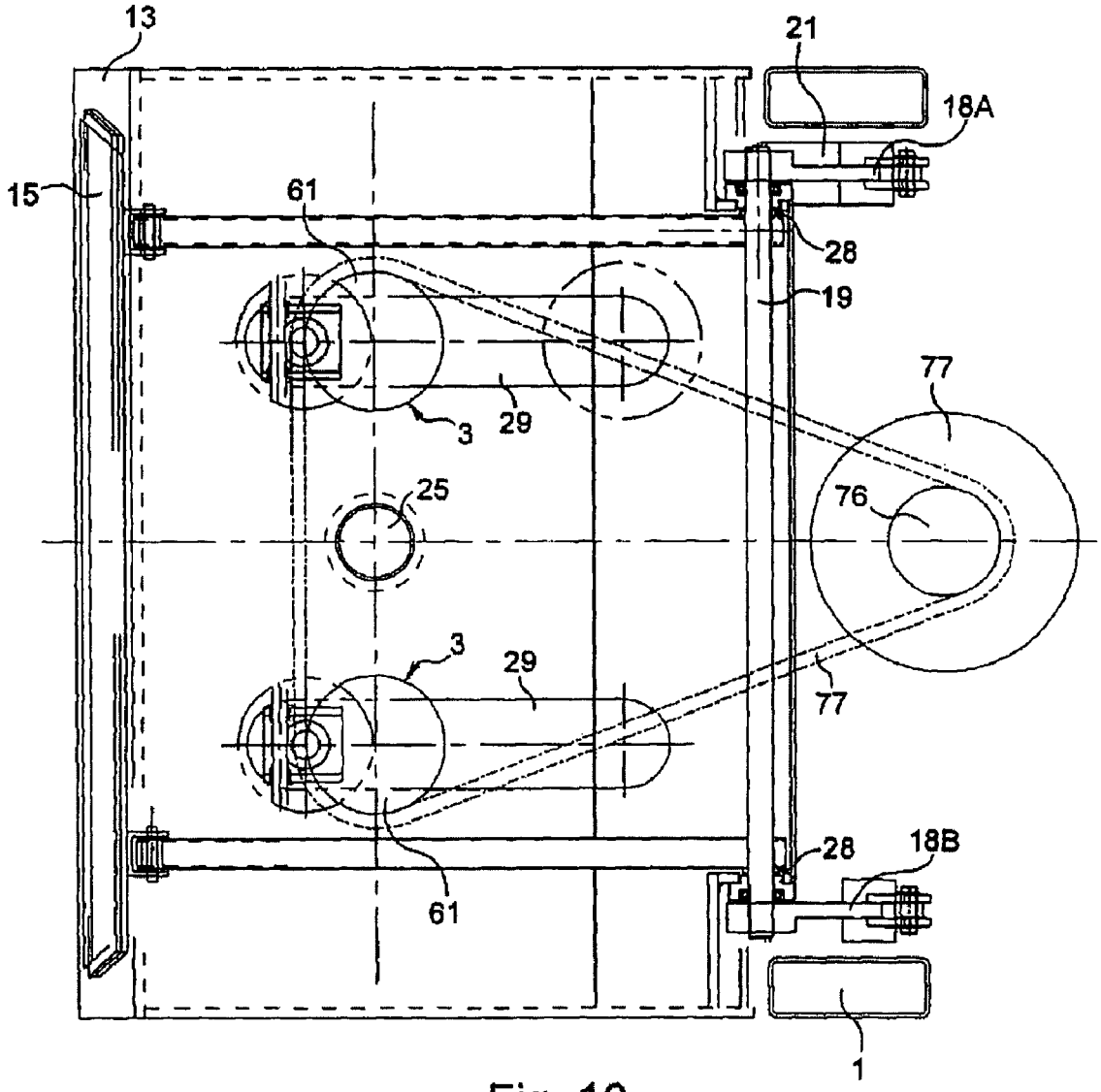
FIG. 10 is a diagrammatic view from above of the machine of FIG. 1.

With reference to FIGS. 4 and 5, the device enabling door 15 to be opened and closed comprises two arms 17 laterally fixed onto the door 15 and each rigidly connected to a shaft 19 rotatably mounted on enclosure 13 via roller bearings 20 (see FIGS. 3 and 10). The fluid-tightness of the work chamber 2 adjacent shaft 19 is provided by seals 28.

Each of the ends of shaft 19 is rigidly connected to a link 18A, 18B enabling opening and closing of the door 15 to be actuated. One of the links 18A is actuated by a jack 21, for example a pneumatic, electric or hydraulic jack. In FIG. 4, with door 15 closed, jack 21 is in retracted position and is adapted to maintain that position to provide effective closure of the door 15. The extended position of jack 21 actuates link 18 to a position in chain line in FIG. 4 and which corresponds to the position represented in FIG. 5, thus bringing the door 15 to an open position.

A closure sensor may prevent the machine from starting if door 15 is not closed. The closure sensor may be fixed on the link 18 to prevent its pollution and to reduce the cost, if the sensor is in the chamber it must be fluid-tight.

The other link 18B may be accessible from the outside of the machine, for example through a hatch, in order to enable the door to be manually opened in case of failure of the jack 21.

The bottom of the work chamber 2 is constituted by a platform 23 fastened to the enclosure 13. This platform 23 comprises two circular openings 24 enabling the spindles 3 to be mounted and also comprises a central opening 25 (see FIGS. 2 and 10) enabling the polishing fluid to be evacuated from the work chamber 2 to the polishing fluid circuit.

FIG. 4 shows that the work chamber 2 also comprises an overflow 26 to avoid it being filled by the polishing fluid in case of blockage of the central opening 25.

The enclosure 13 also comprises, on its wall on the opposite side from door 15, a distributor 27 enabling fluid-tight passage of the fluid from the polishing fluid circuit to the inside of the work chamber 2 and in order to distribute that fluid to the projection units described later.

The wall forming the roof of the enclosure 13 comprises two oblong holes 29 for passage of the devices bearing the polishing tools 5 as well as for their forwards and rearwards horizontal movement. In FIG. 4, the polishing tool 5 represented is shown in its most forward position, with its most rearward position being shown in chain line. The most rearward position of the polishing tool 5 is the one represented in FIG. 5.

The means providing the fluid-tightness of the oblong holes 29 must consequently enable the rectilinear movement of the tool 5. To that end, each jack 30 bearing a tool 5 comprises on its periphery a dome 31 of a diameter greater than the width of the oblong hole 29. A longitudinal lip seal 32 is disposed within the work chamber 2, along each oblong hole 29. The lip seal 32 comprises two parallel elastic lips closing against each other so as to obturate the oblong hole 29.

At the dome 31, the two elastic lips of the lip seal 32 close onto the dome 31. In FIG. 2, the jack 30 on the left has been represented with solely its dome, whereas the jack 30 on the right has been represented with its dome covered by the elastic lips of the seal 32.

The lip seal 32 thus continuously closes the oblong hole 29 while enabling the movement of the jack 30 which, locally, deforms the lips of the seal 32 while fluid-tightness is provided thereat by the rubbing of the lip seal 32 against the dome 31.

To provide a second line of defense in terms of fluid-tightness, each oblong hole 29 is also obturated by bellows 33 attached by each end thereof to the outer surface of the enclosure 13 and having a hole receiving jack 30 (see FIG. 4).

The work chamber 2 is mounted on the frame 1 via six vibration dampers 34 connecting the platform 23 to the frame 1. The vibrations produced in the work chamber 2 by the polishing operations are thus not transmitted to the rest of the machine.

Device Providing Holding and Mobility for the Polishing Tools

As the front view of FIG. 2 shows, the polishing machine comprises two polishing tools 5 each borne by a jack 30. The description which follows, directed to a single of the tools 5, nevertheless applies to both tools 5 which are identical.

The device providing holding and mobility for the tool 5 comprises, with reference to FIGS. 2, 4 and 5, a jack 30 provided with a rod 35 on the end of which is fixed the polishing tool 5 such that the jack 30 can actuate the extension and retraction of the tool 5 with respect to the lens 4. The jack 30 is for example a pneumatic, hydraulic or electric jack. It is mounted through the oblong hole 29 in which it is held in place by a shaft 36. Shaft 36 connects jack 30 to a carriage 37.

The two carriages 37 each attached to one of the shafts 36 are attached together by a beam 38 mounted in helical engagement with a ball screw 39. The ball screw 39 is rotatably mounted on a tool-carrier platform 41 via two rolling bearings 40.

The horizontal translation of each of the carriages 37 which permits the horizontal movement of the shaft 36, and consequently of the jack 30 bearing tool 5, is enabled by its sliding mounting on a cylindrical rail 42 via a sliding sleeve 43. Rails 42 are also mounted by each of their ends to tool-bearing platform 41.

A motor 44 is mounted on tool-bearing platform 41 in order to be able to drive the ball screw 39 to rotate by means of a belt 45.

Motor 44 is preferably a servomotor in order to generate the least possible vibrations in the top of the polishing machine. The motor 44 comprises an integrated encoder giving control over the linear position of the carriages 37, i.e. of the horizontal position of the tools 5.

The rigid assembly formed by the two carriages 37 and the beam 38 is thus mounted for translational movement between a forward position in which the jacks 30 are at one end of the oblong hole 29, and a withdrawn position in which the jacks 30 are at the other of the ends of the oblong hole 29. This translational movement is thus guided by three axes, i.e. by the rails 42 and the ball screw 39, the latter moreover enabling that translational movement to be motorized.

The ball screw 39 and the rails 42 each comprise bellows 46 enabling them to be protected from exterior pollution.

The tool-carrier device is thus entirely mounted on a platform 41 as a sub-assembly of the polishing machine. Such a configuration enables a polishing machine to be produced by separately mounting the parts on the platform 41, and then by mounting that sub-assembly on the complete machine simply by fixing the platform 41 onto the work chamber 2 and the frame 1.

The tool-carrier platform 41 comprises two openings identical to the oblong holes 29 of the work chamber 2 such that, on mounting the tool-carrier assembly 41 on the work chamber 2, those openings are placed facing the oblong holes 29 to enable the horizontal translational movement of the jack 30 disposed transversely to the oblong hole 29.

Figure 8:
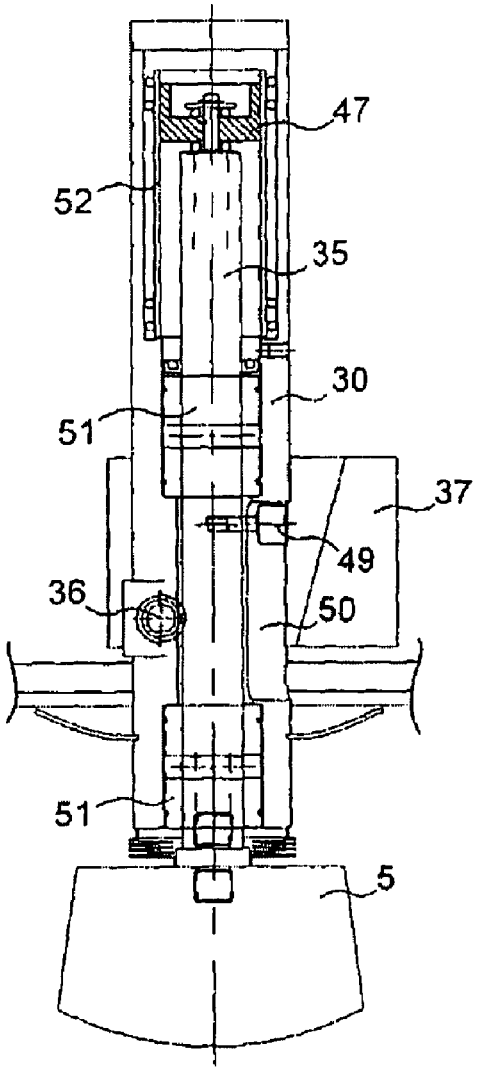
FIGS. 8 to 9 each show a cross-section of one of the tool-carrier jacks of the machine of FIG. 1, respectively in retracted position and extended position.
Figure 9:
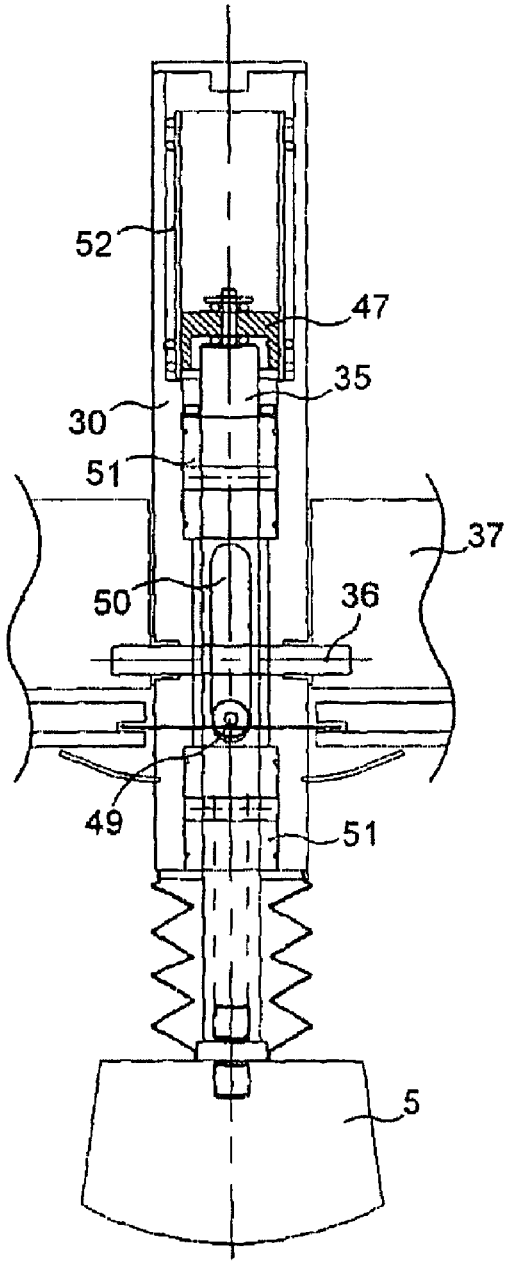

Each of the jacks 30 is identical to the jack represented in FIGS. 8 and 9, respectively from the side and from the front. Jack 30 is mounted to turn on the shaft 36.

Jack 30 comprises a piston 47 connected to rod 35 of which the end is screwed into tool 5.

FIG. 8 shows jack 30 with its rod 35 in retracted position and FIG. 9 shows jack 30 with its rod 35 in extended position. A screw 49 cooperating with an oblong hole 50 enables the travel of the piston 47 and of the rod 35 to be limited between those two extended positions, and also enables their rotation around the longitudinal axis of jack 30 to be prevented.

Two ball bearing linear bushings 51 guide the translational movement of the rod 35 and bear the radial loads generated by the work of the tool 5.

Better reactivity and better precision of the jack 30 are obtained by using a piston 47 of carbon and a cylinder 52 of glass (by virtue of the low coefficient of friction obtained by the cooperation between the carbon and the glass).

Figure 6:
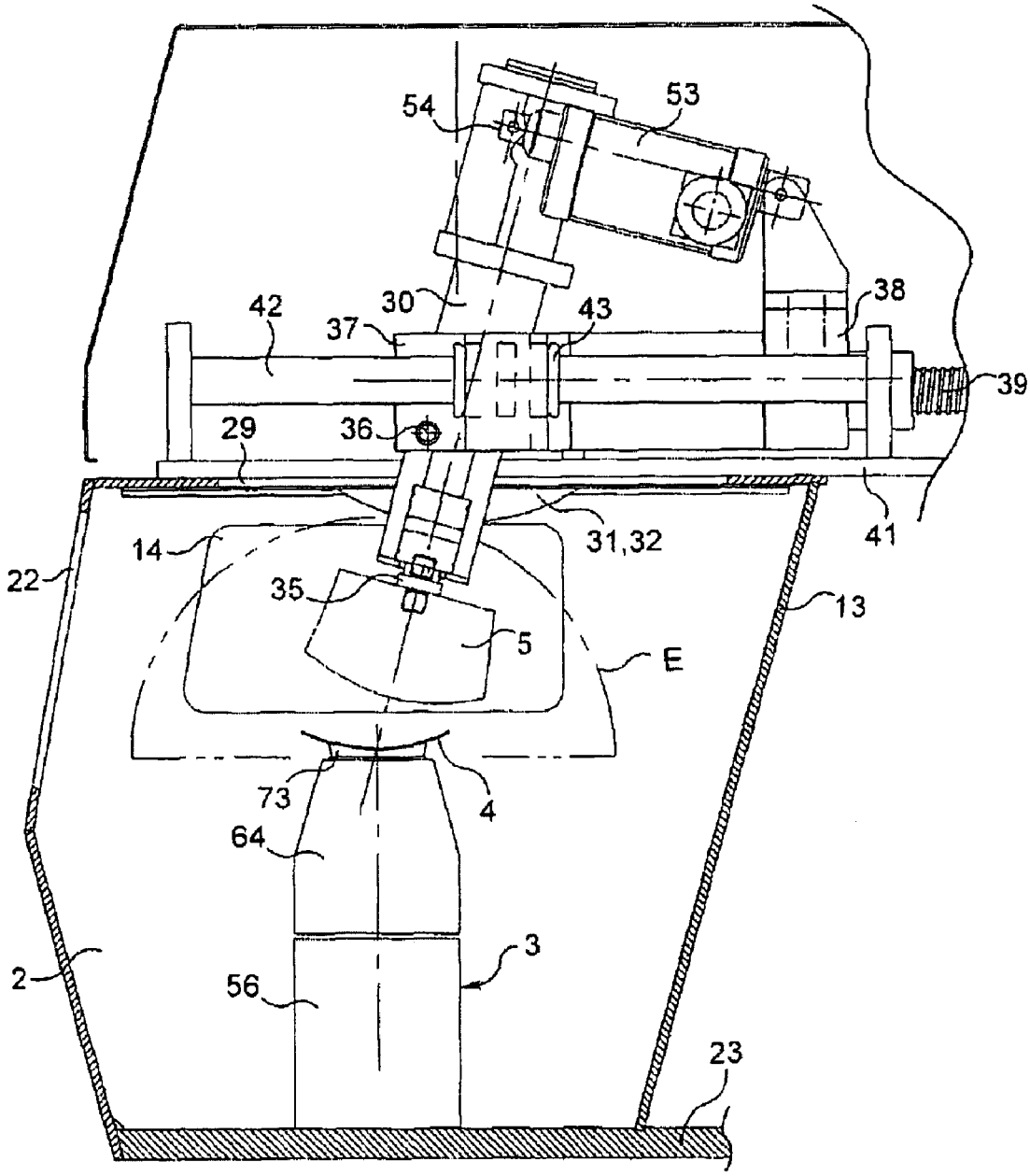
FIG. 6 is a longitudinal cross-section view of the work chamber above which is mounted the tool driving device of the machine of FIG. 1.
Figure 7:
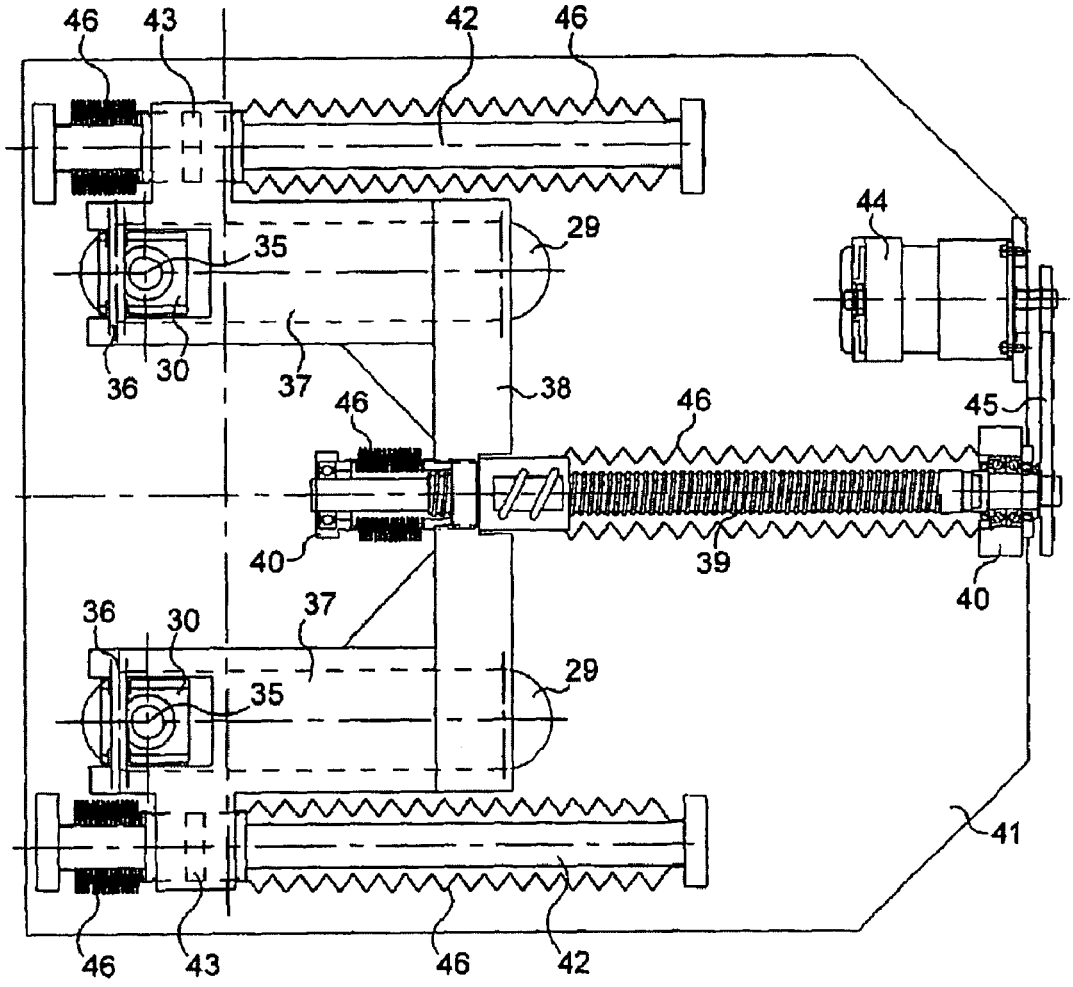
FIG. 7 is a view from above of the machine of FIG. 1 showing the tool driving device.

As FIG. 6 shows, jack 30 is adapted to pivot about shaft 36. By virtue of this pivotal movement and the course of travel of jack 30, tool 5 is able to occupy any position within the hemisphere E (indicated in FIG. 6) while assuming an angle which is, in the present example, a maximum of 15°. The hemisphere E is a space that must be free to load and unload the lens. The pivotal movement of jack 30 by 15° and the translation of jack 30 by 90 mm enables tool 5 to polish convex or concave lenses.

With reference to FIGS. 4 to 6, the means for actuating the pivotal movement of jack 30 comprise a jack 53 disposed between the beam 38 and a bar 54 (see FIG. 2) rigidly connected to the upper portion of each of the jacks 30.

Jack 53 may for example be a pneumatic, hydraulic or electric jack.

FIG. 5 shows jack 53 in extended position, which corresponds to a vertical position of jack 30. In FIG. 5, chain line 55 shows the position of the longitudinal axis of jack 30 when the latter has pivoted under the effect of the retraction of the rod of jack 53.

With regard to this, FIG. 6 represents jack 30 in its position of maximum pivotal movement, jack 53 being in retracted position.

Jack 53 preferably comprises a non-return device enabling jack 30, even during polishing, to stably occupy the different positions corresponding to the different angles of pivotal movement determined by jack 53.

Jack 53 also preferably comprises an integrated encoder for controlling the angle of inclination of jack 30.

Spindles 3 for Holding and Rotating the Lenses to Polish

Figure 11:
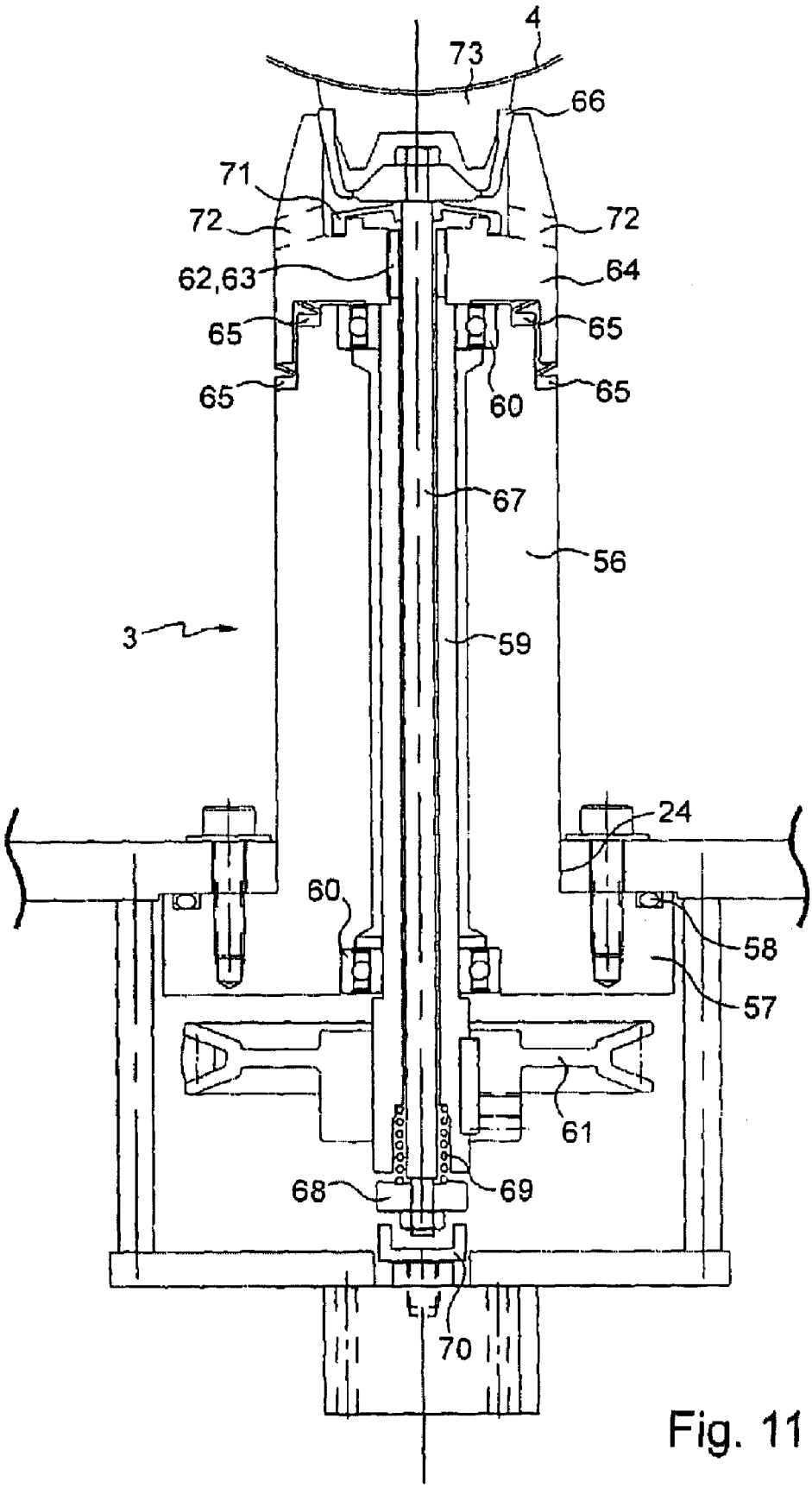
FIG. 11 is a detail view of the machine of FIG. 1, showing a longitudinal cross-section of one of the spindles adapted to bear and rotationally drive an ophthalmic lens to be polished.

FIG. 11 shows in detail one of the two identical spindles 3 which the polishing machine comprises (see FIG. 2).

Spindle 3 comprises a cylindrical body 56 of a diameter fitting the openings 24 of the work chamber 2. The cylindrical body 56 is provided with a base 57 for it to be mounted against the platform 23 of the work chamber 2. This mounting is rendered fluid-tight by virtue of an "O" ring seal 58.

A sleeving member 59 is rotatably mounted within the cylindrical body 56 via two bearings 60. At its lower end, a pulley 61 is rotationally coupled to sleeving member 59 via a key.

The upper end of the sleeving member 59 comprises splines 62. The splines 62 are engaged in the splines 63 of a rotating head 64 which is consequently rotationally coupled to the sleeving member 59 and which bears on the upper bearing 60.

The rotating head 64 may thus be rotationally driven conjointly with the pulley 61 via sleeving member 59. Lip seals 65 provide fluid-tightness between the body 56 and the rotating head 64, even when the latter is rotating.

Spindle 3 further comprises a chuck 66 screwed to the end of a rod 67 extending through the sleeving member 59 and emerging at its lower end by a clamp 68 associated with a compression spring 69. Clamp 68 is adapted to cooperate with an actuator 70.

A diaphragm seal 71 provides fluid-tightness between rod 67 and the rotating head 64, even when these two parts undergo mutual radial movement.

The polishing fluid and the impurities falling into rotating head 64 cannot thus infiltrate into the rotating parts of spindle 3. The polishing fluid and the impurities are moreover evacuated by whip holes 72, under centrifugal force.

Chuck 66 is here shown holding an ophthalmic lens 4 to polish, via an adhesive peg 73 fixed to the lens 4.

A pedal accessible to the operator enables the chuck 66 to grip and release the peg 73.

The two spindles 3 of the polishing machine enable the lenses 4 to polish to be rotationally driven by a motor 74 (see FIGS. 1, 3, 4 and 5) mounted on platform 23 via vibration dampers 75.

Motor 74 is the main source of noise of the polishing machine, but the vibrations produced by it are not transmitted to the platform 23 thanks to the vibration dampers 75.

With reference to the diagrammatic view of FIG. 10, the motor 74 comprises a pulley 76 cooperating with a belt 77 driving the pulleys 61 of each of the spindles 3.

Polishing Fluid Circuit

Figure 12:
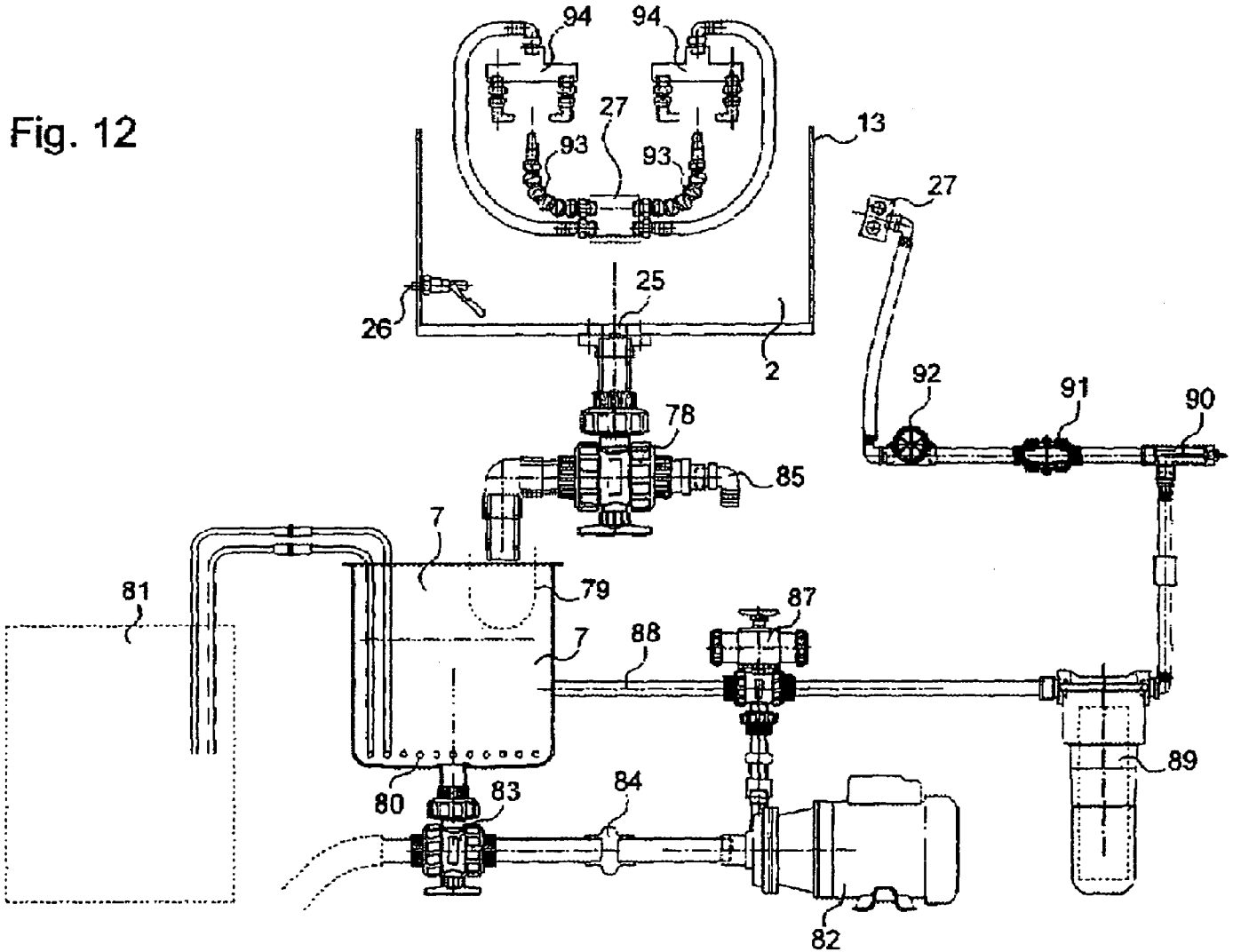
FIG. 12 is a diagram of the polishing fluid circuit integrated into the machine of FIG. 1.

FIG. 12 shows the group of components making up the circuit, in a diagrammatic view not taking into account their position within the polishing machine but enabling their mutual relationship to be illustrated.

Enclosure 13 of the work chamber 2 appears here as a container for the polishing fluid. The latter flows by gravity into the central opening 25 towards a diverter valve 78 and then to the tank 7. Diverter valve 78 also enables the flow in the central opening 25 to be directed to a cleanout drain 85. A filter grid 79 mounted in tank 7 enables a first filtering operation to be made of foreign bodies present in the polishing fluid coming from the work chamber 2. The drawer 6 (see FIG. 1) enables the filters to be changed or cleaned and provides access for the cleaning out operations.

The polishing fluid present in tank 7 is cooled by means of a coil 80 connected to a chiller 81. The system has changed there is now a heat exchanger to cool the polishing liquid that is external to the tank. It is better because there is no risk of freezing and condensation.

A pump 82 circulates the polishing fluid from the bottom of tank 7 to the rest of the circuit, via a diverter valve 83 and a hump hose 84. Diverter valve 83 also enables the polishing fluid to be directed to a system drain.

Pump 82 sends the polishing fluid to a diverter valve 87 which directs the fluid either to a line 88 back to tank 7, or to a fine filter 89 provided with a replaceable cartridge.

The fluid leaving filter 89 is directed towards the distributor 27 in the work chamber 2 successively via a temperature sensor 90, a valve 91 and a flow rate sensor 92. The distributor 27 shown from the side at the end of the circuit is also shown from the front at the left of the drawing, within the work chamber 2.

The distributor 27 then directs the polishing fluid to two fixed hinged nozzles 93 and also to two moving double nozzles 94.

The fixed hinged nozzles 93 are each directed towards one of the lenses to polish whereas the moving double nozzles 94 are each mounted on the body of one of the jacks 30 and are directed towards the corresponding tool 5.

An overflow 26 operated by a float valve prevents accidental filling of the work chamber 2 by the polishing fluid.

For reasons of security, the launch of the polishing cycle, which starts the movement of the spindles 3 and the tools 5 as well as the circulation of the polishing fluid, is performed by two side buttons 95 (see FIG. 2) which have to be pressed simultaneously, so requiring the operator to keep both hands on the buttons 95 on start-up of the machine.

The invention claimed is:

1. A polishing machine for optical elements, comprising:
a spindle arranged to rotationally drive an optical element;
a polishing tool mobile relative to the spindle;
a platform mounted as a separable subassembly on top of a work chamber,
wherein the work chamber comprises the spindle, wherein the platform holds a first jack on which is mounted the polishing tool, and wherein the first jack is pivotally mounted on sliding means by way of a shaft; and
a second jack arranged to pivotally drive the first jack.

2. The polishing machine according to claim 1, wherein the sliding means are mounted on a rail affixed to the platform.

3. The polishing machine according to claim 1, wherein the sliding means are driven by a ball screw mounted on the platform.

4. The polishing machine according to claim 3, wherein the ball screw is rotationally driven by a motor affixed to the platform.

5. The polishing machine according to claim 3, wherein the ball screw is protected by bellows.

6. The polishing machine according to claim 1, wherein the sliding means are mounted on a rail which is protected by bellows attached to the sliding means.

7. The polishing machine according to claim 2, wherein the work chamber comprises a door enabling the access to the spindle and to the polishing tool, the door being rotationally mounted on an arm.

8. The polishing machine according to claim 7, wherein the arm is rotationally mounted relative to the work chamber by way of a shaft.

9. The polishing machine according to claim 8, wherein the arm is rotationally driven around the shaft by a yet further jack.

10. The polishing machine according to claim 2, wherein the polishing machine further comprises a second spindle arranged to cooperate with a second polishing tool mounted on a further jack which is secured on the platform.

11. The polishing machine according to claim 2, wherein the first jack comprises a rod that is arranged to hold the polishing tool.

12. The polishing machine according to claim 2, wherein the polishing machine further comprises a polishing fluid circuit for projecting polishing fluid into the work chamber, the polishing fluid circuit comprising a drawer releasable from the polishing machine and holding a tank, a pump and a filter.

13. The polishing machine according to claim 12, wherein the drawer is arranged to move relative to the work chamber.

14. The polishing machine according to claim 12, wherein the polishing fluid circuit comprises a quick release coupling mounted on the drawer and arranged to disconnect the drawer from the rest of the polishing machine.

15. The polishing machine according to claim 2, wherein the spindle is rotationally driven by a motor located at the same level as the spindle.

16. The polishing machine according to claim 15, wherein the motor and the spindle are mounted on a same further platform.

17. The polishing machine according to claim 15, wherein the motor rotationally drives the spindle by way of a belt.

18. The polishing machine according to claim 2, wherein the platform is insulated from the work chamber by means of a dome attached to the first jack and a lip seal closing onto the dome.

19. The polishing machine according to claim 2, wherein the polishing machine further comprises bellows attached to the first jack and to the platform.

* * * * *

UNITED STATES PATENT AND TRADEMARK OFFICE

CERTIFICATE OF CORRECTION

PATENT NO. : 7,591,710 B2
APPLICATION NO. : 11/320734
DATED : September 22, 2009
INVENTOR(S) : Drain et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 219 days.

Signed and Sealed this

Twenty-first Day of September, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,591,710 B2
APPLICATION NO. : 11/320734
DATED : September 22, 2009
INVENTOR(S) : James W. Drain It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 219 days.

Col. 8, line 49, please amend "claim 2" to read -- claim 1 --

Col. 8, line 59, please amend "claim 2" to read -- claim 1 --

Col. 8, line 63, please amend "claim 2" to read -- claim 1 --

Col. 8, line 66, please amend "claim 2" to read -- claim 1 --

Col. 9, line 12, please amend "claim 2" to read -- claim 1 --

Col. 10, line 6, please amend "claim 2" to read -- claim 1 --

Col. 10, line 10, please amend "claim 2" to read -- claim 1 --

Signed and Sealed this

Twenty-eighth Day of September, 2010

David J. Kappos

David J. Kappos
*Director of the United States Patent and Trademark Office*